US005746670A

United States Patent [19]

Brady

[11] Patent Number: 5,746,670

[45] Date of Patent: May 5, 1998

[54] BATTING SWING TRAINING DEVICE

[76] Inventor: Steven Garvin Brady, 4511 McDonald Dr. N., Stillwater, Minn. 55082

[21] Appl. No.: 735,686

[22] Filed: Oct. 23, 1996

[51] Int. Cl.[6] ..... A63B 69/40

[52] U.S. Cl. ..... 473/451; 473/432

[58] Field of Search ..... 473/451, 421, 473/432, 417, 431; 124/7, 79; 7/7

[56] References Cited

U.S. PATENT DOCUMENTS

| | | | |
|---|---|---|---|
| 1,203,027 | 10/1916 | McMillan . | |
| 3,911,888 | 10/1975 | Horvath . | |
| 4,021,036 | 5/1977 | Nelson et al. . | |
| 4,074,905 | 2/1978 | High . | |
| 4,207,857 | 6/1980 | Balka, Jr. . | |
| 4,220,331 | 9/1980 | Smith . | |
| 4,272,078 | 6/1981 | Vinette . | |
| 4,575,080 | 3/1986 | Miles . | |
| 4,858,921 | 8/1989 | Eustice et al. . | |
| 4,865,318 | 9/1989 | Lehmann et al. . | |
| 5,002,274 | 3/1991 | Bidema . | |
| 5,056,782 | 10/1991 | Giovagnoli . | |
| 5,108,102 | 4/1992 | Logan . | |
| 5,160,131 | 11/1992 | Leon . | |
| 5,205,564 | 4/1993 | Lamberti et al. | 473/421 |
| 5,221,081 | 6/1993 | Rooks | 124/7 |
| 5,294,109 | 3/1994 | Meade . | |
| 5,338,025 | 8/1994 | Giovagnoli . | |
| 5,485,994 | 1/1996 | Underwood et al. | 473/451 |

FOREIGN PATENT DOCUMENTS

| | | | |
|---|---|---|---|
| 2355830 | 5/1974 | Germany | 124/7 |

*Primary Examiner*—Mark S. Graham
*Attorney, Agent, or Firm*—Merchant, Gould, Smith, Edell, Welter & Schmidt, P.A.

[57] ABSTRACT

An automated batting swing training apparatus for providing a continuous, successive supply of predominantly vertically tossed balls for a batter to hit. The apparatus includes a ball projector that propels balls for the batter to hit. The balls are propelled from the ball projector in a predominantly vertical direction. A ball stopping backstop includes a section to absorb the force of the balls resulting from being hit by the batter. The automated batting swing training apparatus further includes a detachable guide channel that connects to the backstop, collects the balls from the backstop, and directs the balls to a channel arm that returns the collected balls to the ball projector, where they may again be hit by the batter.

1 Claim, 9 Drawing Sheets

SIDE VIEW

REAR VIEW

BATTING SWING TRAINING DEVICE

FIELD OF THE INVENTION

The present invention relates generally to batting training devices, and more particularly to a method and apparatus for providing a continuous, successive supply of predominantly vertically tossed balls for a batter to hit.

BACKGROUND OF THE INVENTION

There are various drills and mechanisms for allowing a batter to practice form and technique for hitting balls, such as baseballs. Many of these mechanisms simulate a horizontally pitched ball as would be thrown by a person pitching the ball from the pitching mound. Such a drill allows the batter to practice hitting a ball having the speed and trajectory of an actual pitched ball. Other drills are designed to allow a hitter to practice bat swing form and technique, bat speed, power and timing. A common drill of this sort includes a person lobbing, or "tossing" a ball from a position directly facing the batter from a relatively short distance. The tosser typically stands or kneels several feet away from the batter, yet facing the batter, and lobs the ball to the batter so the batter can hit the ball in a direction roughly perpendicular to the direction in which the ball was tossed to the batter.

The ball tossing drill has traditionally required a person, the tosser, to continually toss balls to the batter, and collect the balls after they have been hit by the batter. However, various ball tossing devices have been devised to eliminate the need for a human tosser to be present. These devices typically include a mechanism to drive a ball upward from a position directly in front of, and relatively near to, the batter for the batter to hit. However, the hitter must load the device with one or more balls which are then hit by the batter, who must then collect the balls, and return the balls to the ball tossing device. Other ball tossing systems suggest hitting the balls into a net, which stops the balls and allows the batter to move a shorter distance in collecting the balls.

These devices fail to provide a batting training system which automatically provides a continuous series of tossed balls. It is therefore desirable to devise a ball tossing system that automatically reloads the ball tossing device rather than requiring manual reloading of the tossing device. It is also desirable to provide such a system which allows for this automatic cycling in a relatively small area, having components which are detachable and portable. It is further desirable to provide a system that is not limited to those sporting activities utilizing a baseball or softball "bat", as the system can also be extended to other sporting activities where continually batting a particular type of ball with a particular batting device may be desired, such as practicing a tennis swing by continually hitting tennis balls.

The present invention provides a ball tossing apparatus which overcomes the shortcomings of the prior art. Whether used for training or for recreational purposes, the ball tossing system of the present invention allows a hitter to continually hit balls without having to manually reload the ball tossing device. This is particularly advantageous where the batter only has one or a few balls. For example, a single ball could continually cycle through the ball tossing system, however, it would appear to the batter as though an infinite number of balls were being fed into the ball tossing device. The present invention may also be disassembled into only a few major components to provide portability.

SUMMARY OF THE INVENTION

The present invention relates to ball tossing mechanisms including a cooperatively coupled ball projector, ball stopping device and ball return guide channel, to provide a continuous, successive supply of tossed balls for a batter to hit.

In accordance with one embodiment of the invention, an automated batting swing training apparatus is provided which includes a ball projector that propels balls for a batter to hit. The balls are propelled from the ball projector in a predominantly vertical direction. Also included is a ball stopping backstop which includes a section to absorb the force of the balls resulting from being hit by the batter. The section that absorbs the force of the balls may include a variety of non-resilient materials, such as netting or padded material. The automated batting swing training apparatus further includes a guide channel that connects to the backstop, collects the balls from the backstop, and directs the balls to a channel arm that returns the collected balls to the ball projector, where they may again be hit by the batter.

In accordance with another embodiment of the invention, a container is provided to collect the balls from the backstop. The container is connected to a guide channel to direct the balls from the container, to the guide channel, and ultimately back to the ball projector, where they may again be hit by the batter.

In accordance with yet another embodiment of the invention, a method for successively supplying balls to a batter in a position for the batter to hit is provided. The method includes the step of projecting a ball in a substantially upward direction to a position capable of being hit by the batter. The motion of the ball is then stopped, and the balls are collected. The collected balls are automatically returned to again be projected in a substantially upward direction to a position capable of being hit by the batter.

Still other objects and advantages of the present invention will become readily apparent to those skilled in this art from the following detailed description, where various embodiments of the invention are illustrated. As will be realized, the invention is capable of other and different embodiments, and its details are capable of modification without departing from the invention. Accordingly, the drawings and description are to be regarded as illustrative in nature, and not as restrictive.

DETAILED DESCRIPTION OF THE ILLUSTRATED EMBODIMENTS

Figure 1:
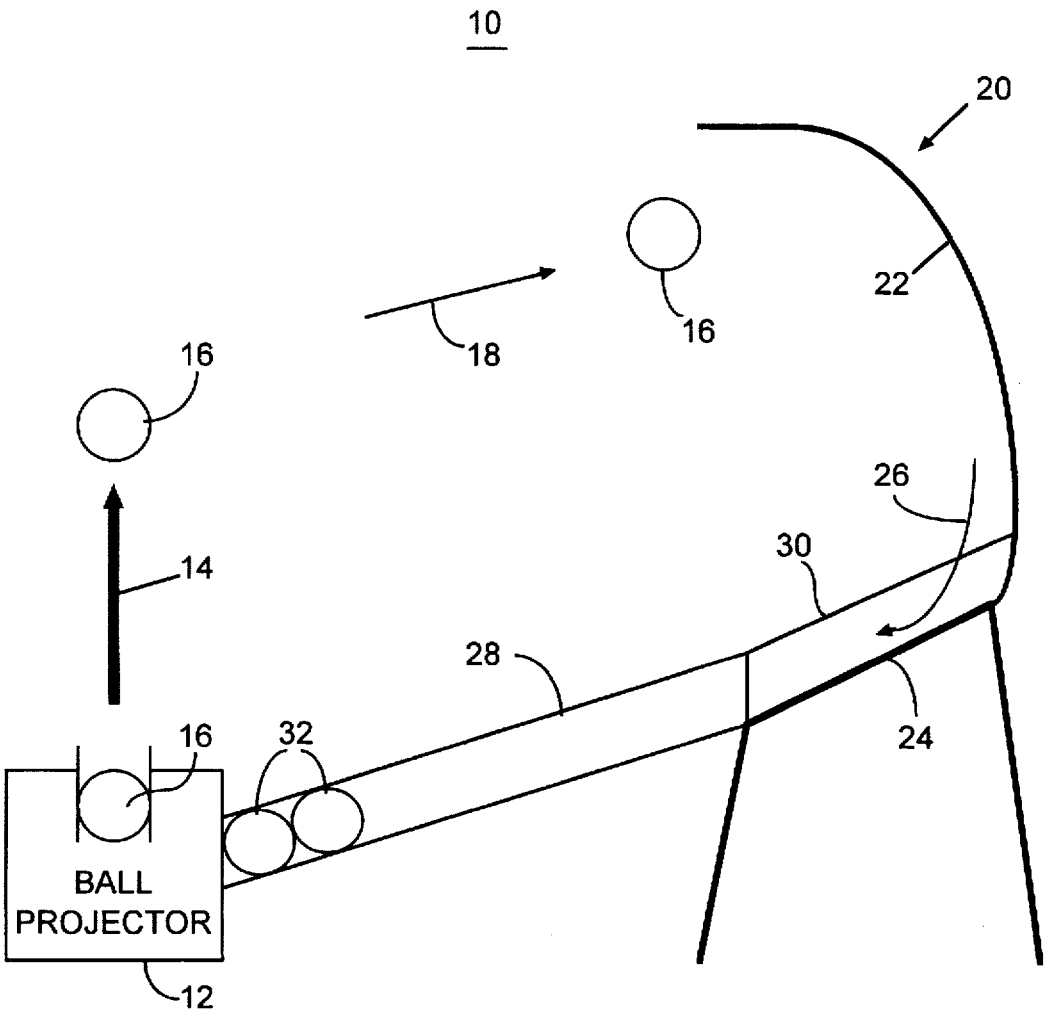
FIG. 1 is a diagram illustrating one embodiment of the batting swing training apparatus in accordance with the invention.

FIG. 1 is a diagram illustrating one embodiment of the batting swing training apparatus 10 in accordance with the invention. A ball projector 12 is used to propel balls in a vertically upward direction represented by arrow 14. After the ball has been propelled by the ball projector 12, a batter standing within reach of the ball 16 can bat the ball in the direction of arrow 18. A structure 20, shown in a skeletal side view, is positioned to stop the motion of ball 16, as well as absorb the impact so as to keep the ball 16 from rebounding from the backstop portion 22 of the structure 20. Ball 16 then drops via gravity to a guide channel portion 24 of the structure 20, as illustrated by arrow 26. The guide channel 24 in the embodiment of FIG. 1 is downwardly sloped to allow the ball 16 to be directed to channel arm 28, which leads back to the ball projector 12. Guide rails 30 can be provided on the guide channel 24 to direct the balls from the guide channel 24 to the channel arm 28, where the balls are returned to the ball projector 12. The batting swing training apparatus 10 is not limited to traditional "batting" as used in the sport of baseball, as the apparatus 10 can also be extended to other sporting activities where continually batting a particular type of ball with a particular batting device may be desired, such as continually hitting tennis balls with a tennis racquet.

As can be seen in FIG. 1, the batting swing training apparatus 10 provides a continuous cycle of balls for a batter to hit. The training apparatus 10 can continually cycle a single ball, or can continuously cycle multiple balls which are cued in the channel arm 28 as shown by cued balls 32. Whether multiple balls can be cued into the ball projector 12 depends somewhat on the type of ball projector 12 used. There are a variety of different types of devices which will propel a ball in an upward direction, however, a ball projector is required which can continuously receive additional balls 32 from a relatively low position. The ball projector 12 should have a relatively short height so as not to threaten interfering in the batter's swing. The balls should be received at the ball projector 12 at a relatively low position, so that the channel arm 28 can be sloped upward to the guide channel 24, while having the guide channel 24 be as low as possible to maximize the area of the backstop portion 22.

In order that the training apparatus 10 be portable, the channel arm 28 is detachable from both the ball projector 12 and the structure 20. The channel arm 28 in FIG. 1 aligns with the guide rails 30 so that balls guided from the guide channel 24 are directed to the channel arm 28. Other embodiments of the guide channel include embodiments where the guide channel is not a part of the structure 20, but rather represents the channel between the ball projector 12 and the structure 20 as shown by channel arm 28 in FIG. 1. Such an embodiment includes a containing unit near the base of the structure 20 which collects the balls stopped by backstop portion 22.

FIG. 1 illustrates one embodiment of a ball stopping structure 20. Backstop portion 22, which is supported by structure 20, includes a non-resilient portion to absorb the force of the ball 16 and minimize any substantial rebound effects from the structure 20. The non-resilient backstop portion 22 includes a netted material in one embodiment of the invention. In another embodiment the backstop portion 22 comprises a padded material which absorbs the horizontal force of the ball 16. Other embodiments of non-resilient materials may be utilized without departing from the scope and spirit of the invention.

Figure 2:
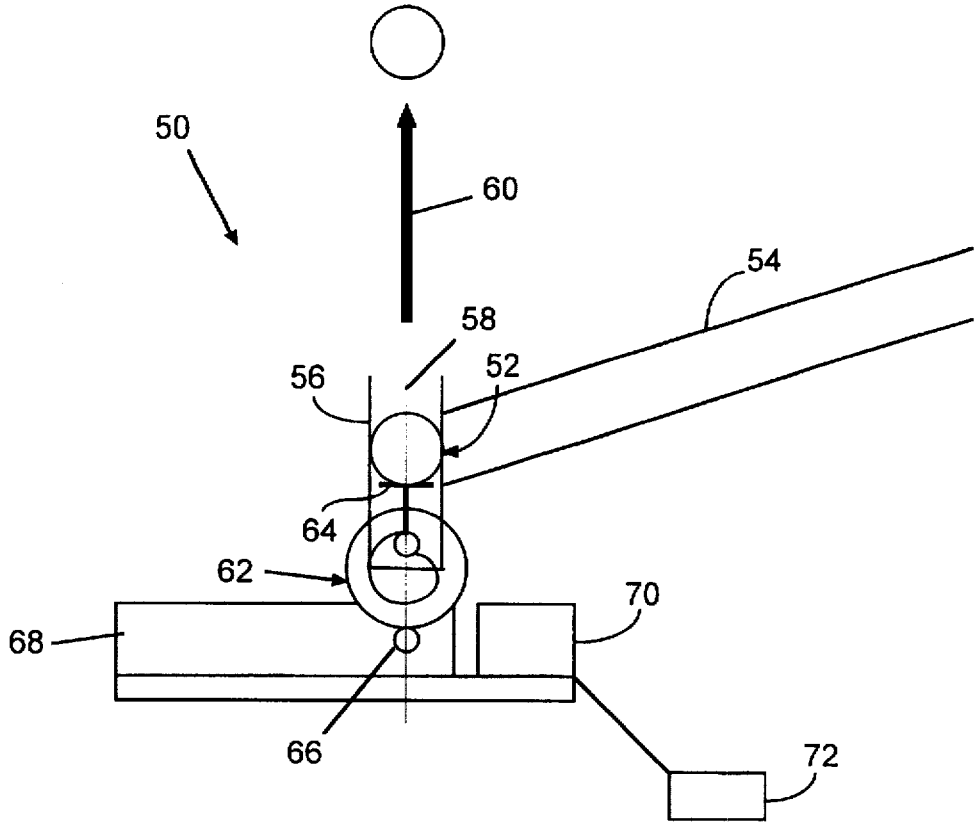
FIG. 2 illustrates one embodiment of a ball projecting unit capable or receiving a continuous stream of balls and upwardly projecting the balls.

FIG. 2 illustrates one embodiment of a ball projecting unit capable or receiving a continuous stream of balls and projecting the balls upward. A side view of a ball projector 50, which can be used in conjunction with the present invention, is shown. Ball projector 50 is an exemplary device for projecting a ball in an upward direction while having a ball entry point at a location low enough to allow a gravity feed from the structure 20, yet allows the backstop portion 22 to be sufficiently low to the ground to maximize the area of the non-resilient material.

The ball entry point 52 is located on the ball projector 50 at the intersection of the channel 54 and the guide tube 56. The guide tube 56 represents the structure from which a ball 58 is propelled. The guide tube 56 therefore helps to guide the balls in a relatively consistent direction as they are released from the ball projector 50. The balls are propelled from the ball projector 50 in the approximate launch direction represented by arrow 60.

The ball projector 50 utilizes a spiral cam mechanism 62 to cause a T-plate 64 to move in a downward motion to compress an axial compression spring (not shown). Generally, a cam utilizes a rotating or sliding member which imparts a desired motion or series of motions to another member. A wheel drive pinion 66 rotates, thereby causing the cam mechanism 62 to rotate. When the cam mechanism 62 has rotated one revolution, the T-plate 64 will be released by the spiral cam mechanism, and will be forced in an upward direction by the axial compression spring, which will be described in further detail in connection with FIG. 3.

The wheel drive pinion 66 is powered by a drive motor 68, which causes the wheel drive pinion 66 to rotate at a desired rotation speed. In order to make the ball projector 50 more portable, a battery pack 70 is provided to supply power to the drive motor 68. The drive motor 68 can be initiated by a variety of electrical switching mechanisms, wherein one embodiment includes a foot-activated switch 72. Pressing the foot-activated switch 72 can be configured as a momentary switch where activating the switch 72 causes one ball to be propelled from the ball projector 50. Alternatively, or in addition to a momentary switch, the foot-activated switch 72 may be a continually activated (e.g., toggle switch) wherein activating the switch 72 causes balls to be periodically propelled from the ball projector 50 until the switch 72 is deactivated.

Figure 3:
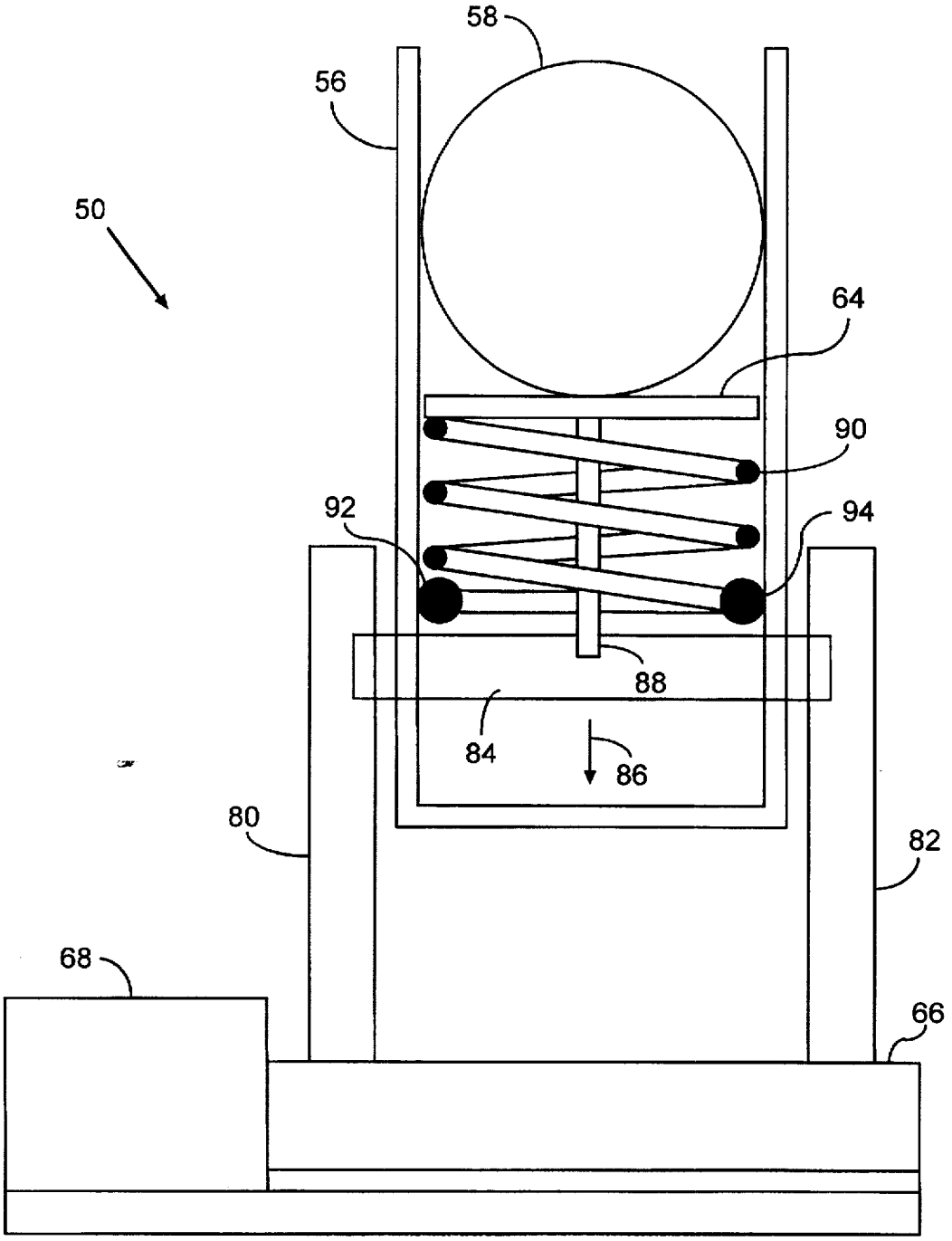
FIG. 3 is a magnified rear view of the ball projector.

Referring now to FIG. 3, a magnified rear view of the ball projector 50 of FIG. 2 is shown. The ball 58 in the guide tube 56 is positioned on the T-plate 64. The drive motor 68 rotates the wheel drive pinion 66, which causes the cam mechanism 62 to rotate. The cam mechanism 62 is shown to include two analogous cam wheels 80 and 82 which, when rotated in the proper direction, cause the cocking rod 84 to move in the direction of arrow 86. The cocking rod 84 is connected to the stem 88 of the T-plate 64, so that the T-plate 64 also moves in the direction of arrow 86 when the cam wheels 80 and 82 are rotated. Moving the T-plate downward causes the axial compression spring 90 to compress and store energy in an amount proportional to its spring constant. The axial compression spring 90 is affixed to a structure which does not move with the T-plate 64. In FIG. 3, the spring 90 is secured to the guide tube 56, where one end of the axial compression spring 90 is shown coupled by fastening mechanism 92. A release mechanism allows the axial compression spring 90 to release its stored energy, thereby causing the ball 58 to be propelled in an upward direction. The height or distance that the ball travels is substantially controlled by the spring constant of the spring 90 and the axial compression distance. Therefore, the height range in which the balls reach can be changed by varying the spring constant. The release mechanism will be described in more detail in connection with FIG. 4.

The precise mechanism used to fasten the spring 90 to the guide tube 56 is not important to the inventive concept, and various fastening means known in the art are capable of performing such fastening function, including, but not limited to, welding or strapping. Another such fastener 94 can be used at another point near the bottom coil of the spring to provide additional support for the spring 90.

Figure 4:
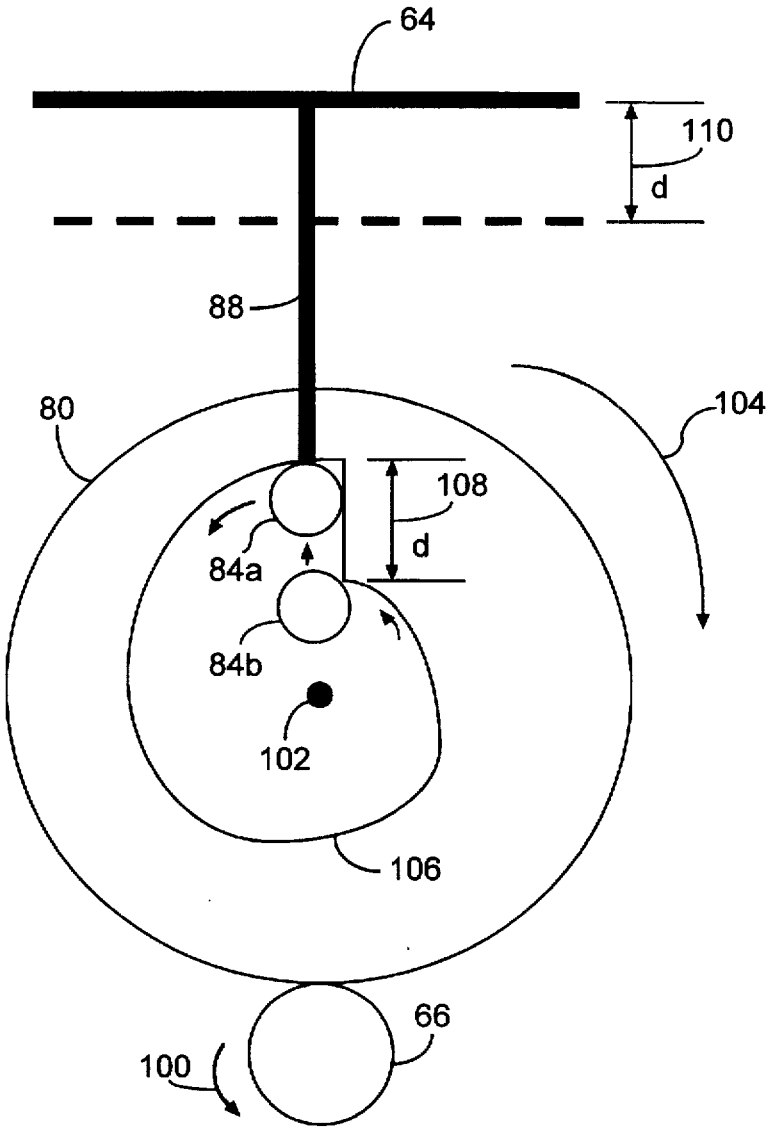
FIG. 4 is a diagram of the operation of one embodiment of the cam wheel.

FIG. 4 is a diagram of the operation of one embodiment of the cam wheel 80. Cam wheel 80 and cam wheel 82 (not shown) operate in a similar manner, and the description relating to cam wheel 80 is similarly applicable to cam wheel 82. As was shown in FIG. 3, the cocking rod 84 engages both cam wheel 80 and 82. One end of the cocking rod 84 is represented by cocking rod 84*a*, which represents the location of the cocking rod 84 within the cam wheel 80. As wheel drive pinion 66 rotates in the direction of arrow 100, cam wheel 80 rotates about an axis 102 in a clockwise direction represented by arrow 104. Rotating the cam wheel 80 in a clockwise manner results in the cocking rod 84*a* moving along the spiral inner surface 106 such that the cocking rod 84*b* is located a distance d, represented by arrow 108, below the original position of cocking rod 84*a*. Because the cocking rod 84 is connected to the stem 88 of the T-plate 64, the T-plate 64 also moves downward a same distance d, represented by arrow 110. It is this downward movement that causes the axial compression spring 90 to store energy as it compresses, as was shown in FIG. 3.

When the cam wheel 80 has completed one revolution, the cocking rod 84*b* reaches the end of the spiral inner surface 106. When the cam wheel has turned far enough, the spring 90 causes the cocking rod 84*a* and the T-plate 64 to abruptly return to their original positions. This abrupt motion causes a ball positioned on T-plate 64 to be propelled.

Figure 5:
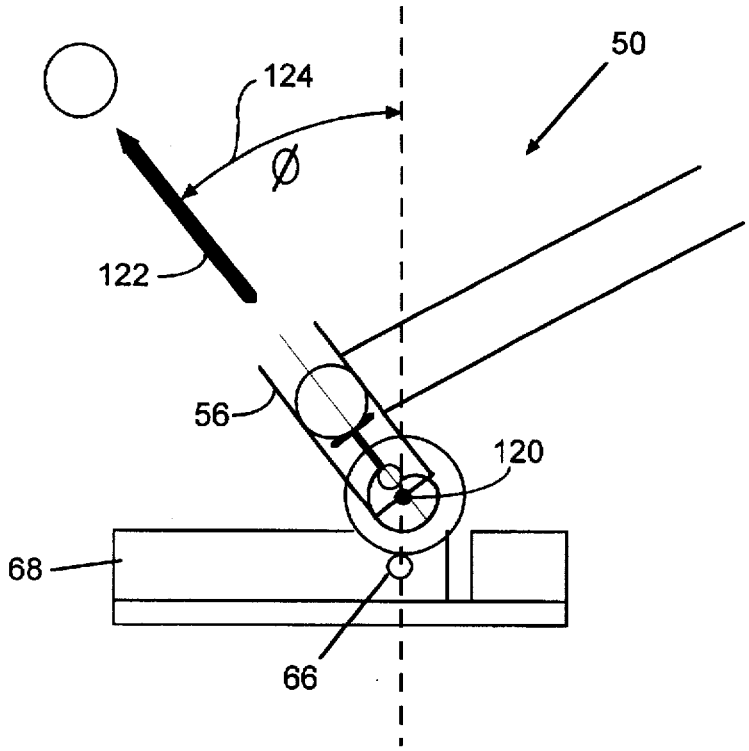
FIG. 5 illustrates another embodiment of the batting swing training apparatus where the launch direction is altered.

FIG. 5 illustrates another embodiment of the batting swing training apparatus 50 where the launch direction is changed. It may be desirable for a batter to hit incoming balls from a projectory path rather than from a substantially straight upward direction. For example, a batter may desire that balls be propelled in a predominantly upward direction, but also from a side position so that the ball has a trajectory arc as it approaches the batter. This emulates a ball being lobbed in an underhand manner, which corresponds to a particular baseball training drill. In such a case, the batting swing training apparatus 50 can be pivoted about an axis 120 in order to allow the launch direction, represented by arrow 122, to be offset from a vertical position by an angle $\phi$ (phi), represented by arrow 124.

Figure 6:
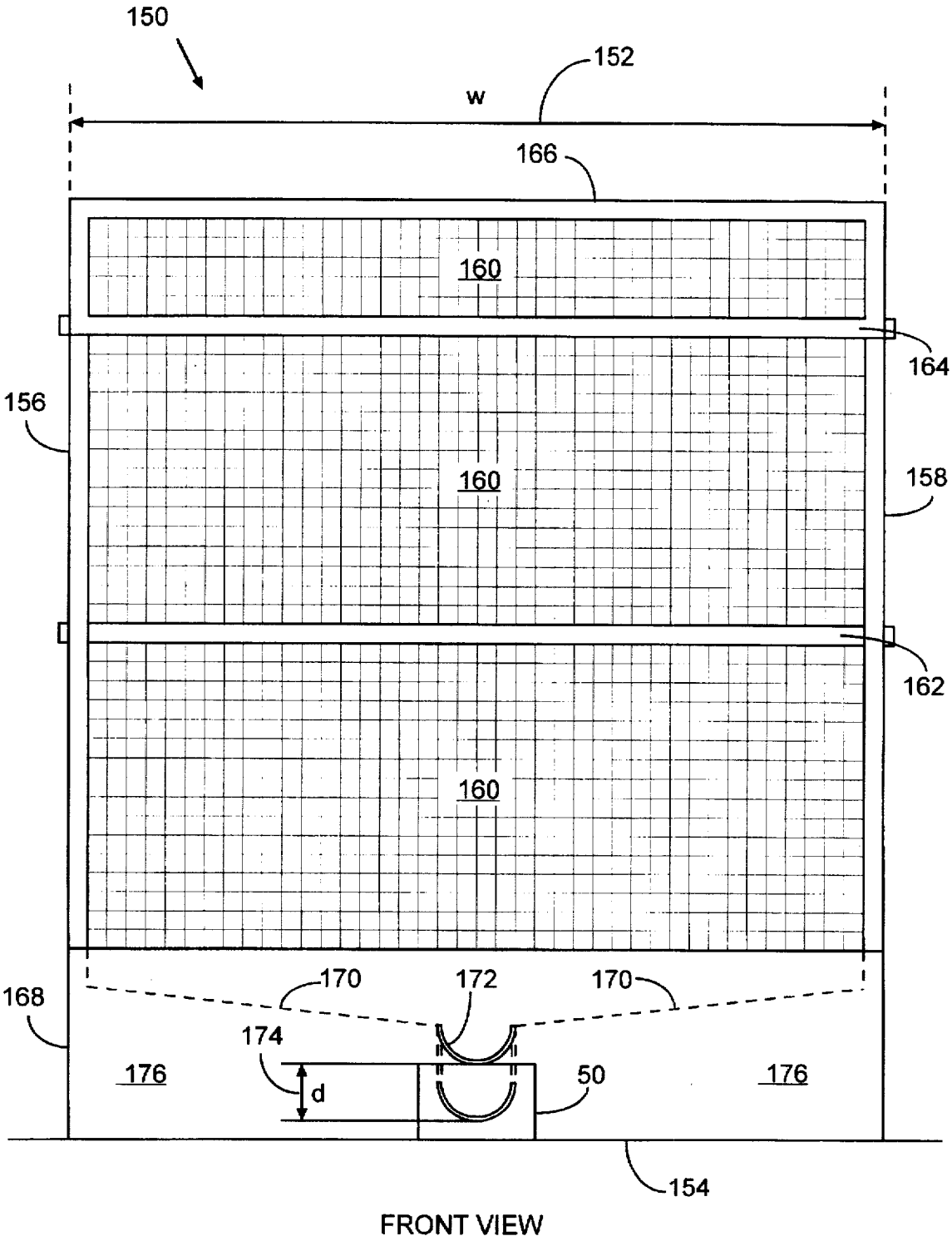
FIG. 6 is a front view of one embodiment of a backstop structure.

Referring now to FIG. 6, a front view of one embodiment of a backstop structure 150 is shown. Structure 150 is shown having a width w, represented by line 152. The width should be wide enough to maximize the area available to stop balls as they are hit toward the structure 150. On the other hand, the structure 150 is preferably designed to provide a path to the channel between the structure 150 and the ball projector (not shown) where the ball is returned to the ball projector via the force of gravity. Therefore, a very wide backstop structure 150 may reduce the area of the available non-resilient backstop material, as the guide channel would be relatively high from the base 154 of the structure 150 near the side frame segments 156 and 158 of the structure 150. A preferable width, depending somewhat on the skill level of the batter, may be between four and eight feet wide, with a preferable median width of six feet.

The non-resilient backstop material 160 in FIG. 6 is represented as a netted material, which is supported by the frame segments of structure 150, including side segments 156 and 158, and crossbar segments 162, 164 and 166. In another embodiment, the backstop material 160 may comprise a padded material which absorbs the horizontal and vertical vector forces of the ball which was hit. Other embodiments of non-resilient materials may be utilized without departing from the scope and spirit of the invention.

In FIG. 1, a guide channel 24 was shown having guide rails 30 to guide the balls from the structure 20 to the channel arm 28. Another embodiment is shown in FIG. 6, where a containing unit 168 is located near the base of the structure 150 and is positioned to collect the balls as they fall from the non-resilient backstop material 160. In another embodiment, the containing unit 168 is detachably coupled to the frame to integrate the containing unit 160 into the structure 150. The containing unit shown in FIG. 6 includes a sloped floor 170 which allows the collected balls to be directed to the guide channel 172 by way of gravity. The balls roll down the guide channel 172 a distance d, represented by arrow 174 to the opposite end of the guide channel 172, which supplies the balls to the ball projector 50.

In yet another embodiment of the structure 150, a hollowed area 176 may store unused balls. Furthermore, the structure 150 is preferably portable, however the structure 150 may be secured at a particular location without departing from the scope of the invention.

Figure 7:
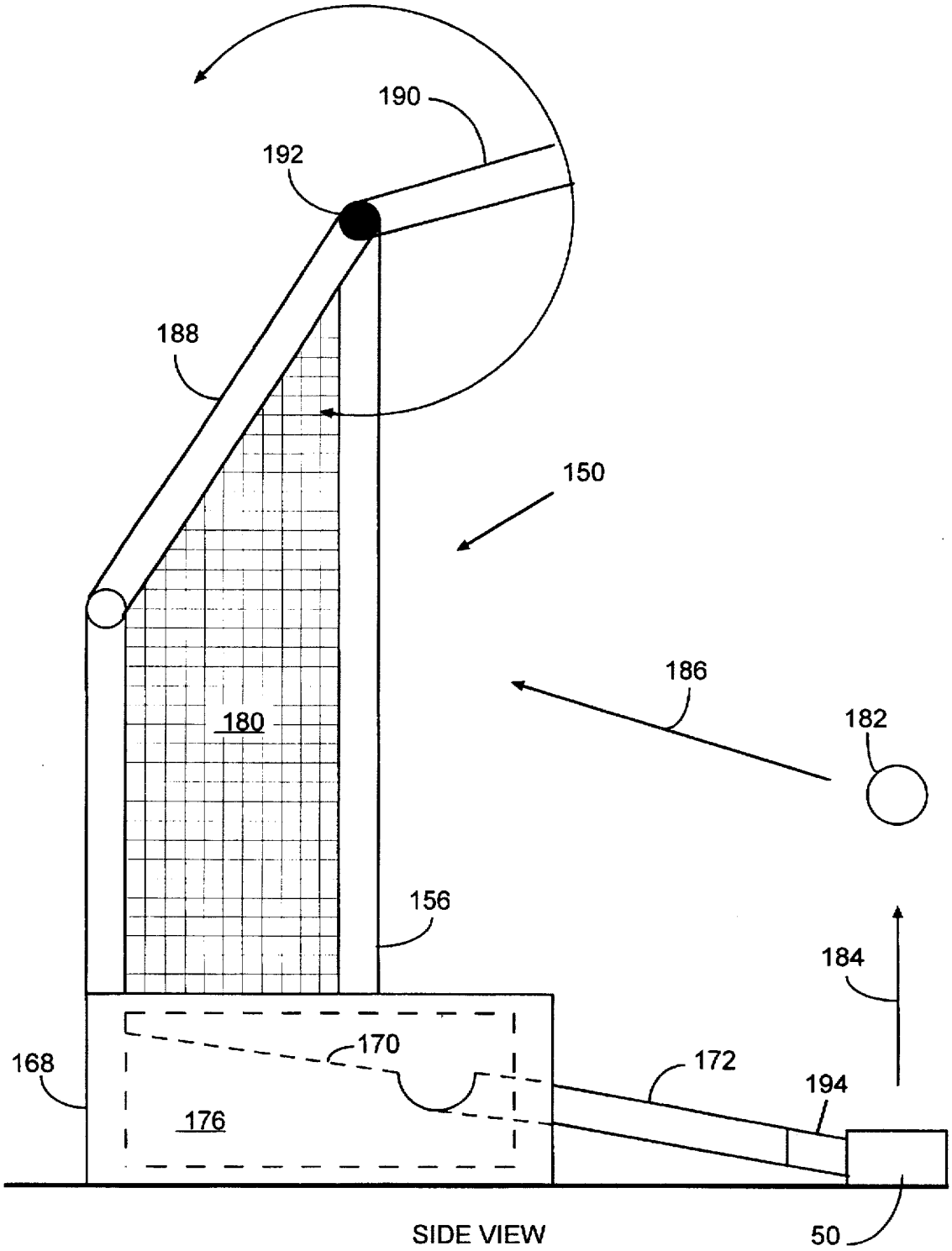
FIG. 7 is a side view of the backstop structure.

FIG. 7 is a side view of the backstop structure 150. The structure 150 of FIG. 7 includes a side section 180 which includes the non-resilient material to help contain the balls in a location above the containing unit 168. The sloped floor 170 of the containing unit 168 is directed to a first end of the guide channel 172, which is sloped to the ball projector 50. The balls 182 are propelled upwards in the direction of arrow 184, are struck by the batter to change the direction of the ball in a direction approximated by arrow 186, wherein the structure 150 then stops balls 182 and redirects the balls 182 into the containing unit 168 via gravity. This cycle can continue indefinitely, which allows the batter to continually hit balls without manually reloading the balls into the ball projector 50.

In one embodiment of the backstop structure 150, a back frame segment 188 is sloped in a direction towards the batter in order to provide a stopping angle more perpendicular to the angle at which a ball will strike that segment 188. For example, where balls are hit into a more upper portion of the backstop structure 150, they will be at a greater angle with respect to a horizontal plane, and angling back frame segment 188 allows the corresponding non-resilient material to be nearer to perpendicular to the trajectory of the ball 182.

In order to expand the area of the backstop structure 150, a rotatable expansion flap 190 is provided, which can also provide structure for the non-resilient material. Expansion flap 190 may be rotated about axis 192, to change the angle and the overall height at which the backstop structure 150 is capable of stopping balls hit by the batter.

The guide channel 172 of FIG. 7 is a detachable segment, which provides a pathway between the containing unit 168 and the ball projector 50. The guide channel can also include the containing unit, such that the guide channel is directly attached to the frame of the backstop structure 150 (see FIG. 1) and a channel arm provides the pathway between the structure 150 and the ball projector 50. The guide channel 172 of FIG. 7 can be a variety of shapes in order to allow balls to roll via gravity to the ball projector 50. One such embodiment is a sloped planar surface bordered by guide rails positioned to direct the collected balls to an entry point of the ball projecting unit 50. Other embodiments include a parabolically-shaped channel, a V-shaped or U-shaped channel, and a cylindrical conduit.

Because the backstop structure 150 is positioned as close to the batter as possible without obstructing the batter's swing, the guide channel 172 is relatively short in length. The backstop structure 150 should optimally be located a distance just beyond the bat swing radius of the batter in order to maximize the projection angles covered by the structure 150. Therefore, the front frame segment 156 must be out of reach of a batter's swing, which will be on the order of three to seven feet, depending on the size of the batter and the bat used. In one particular embodiment of the guide channel 172, extension channel segments 194 can be added or removed to optimize the distance between the batter and the backstop structure 150.

The batting swing training apparatus is capable of cycling a single ball around and around so that the batter is never required to have another person toss balls, or is never required to manually enter a ball into a ball projector. However, there is a time delay from the time the ball is hit until the ball cycles to be propelled again, when only a single ball is cycled. To shorten this delay, the batting swing training apparatus of the present invention allows multiple balls to be used. The ball projector 50 of FIG. 2 allows balls to be queued in the channel 54, and the guide tube 56 may be constructed to have a diameter slightly larger than the diameter of a ball, so that only one ball can enter the guide tube 56 at a time, and the other balls will not interfere with the propelling of the ball 58 from the T-plate 64. However, in order to ensure no interference by queued balls in the channel 54, a sequencing mechanism can be utilized in accordance with the present invention.

Figure 8:
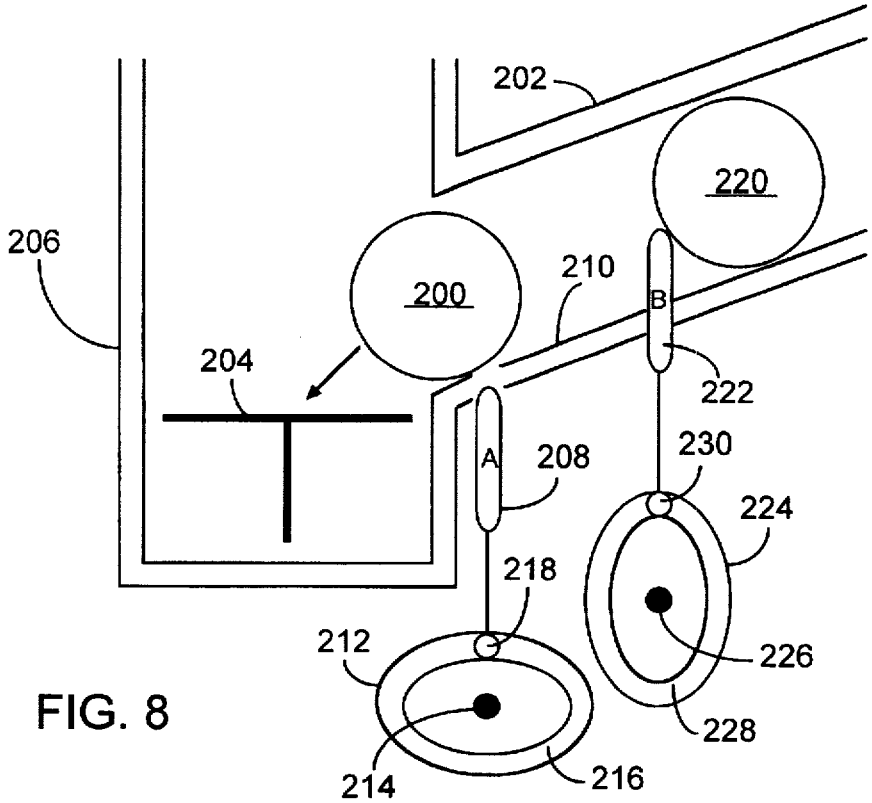
FIG. 8 illustrates a first sequence of a sequencing mechanism which isolates the target ball from the remaining queued balls.
Figure 9:
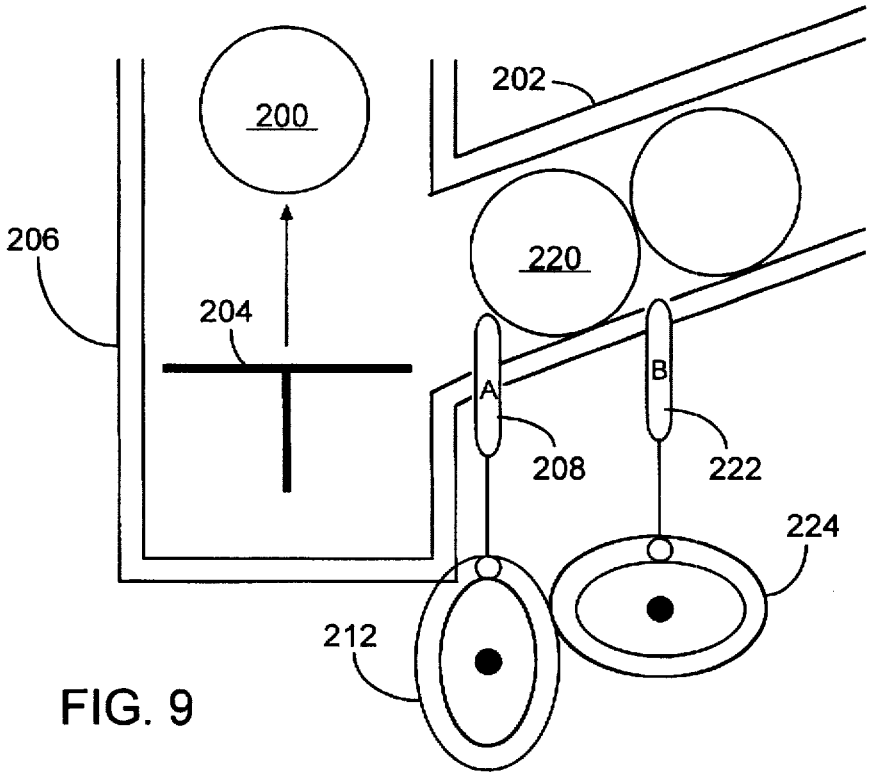
FIG. 9 illustrates a second sequence of the sequencing mechanism which isolates the target ball from remaining queued balls.

FIGS. 8 and 9 illustrate a sequencing mechanism which isolates the target ball (the ball currently positioned to be propelled) from the queued balls, thereby allowing only one ball to enter the guide tube at a time. This ensures that queued balls behind the target ball do not interfere with the propelling of the target ball.

Referring first to FIG. 8, a ball 200 is shown dropping from the guide channel 202 onto the T-plate 204 within the guide tube 206. Ball 200 is allowed to roll onto the T-plate 204 because the rolling inhibitor A 208 is moved to a position below the rolling surface 210 of the guide channel 202. The rolling inhibitor A 208 is moved up and down to allow ball 200 to be respectively inhibited and allowed to roll onto the T-plate 204. In one embodiment, the rolling inhibitor A 208 is moved by way of an oval cam device 212, rotating about an axis 214. The cam device 212 includes a wheel guide path 216 in which wheel 218 follows. Therefore, as the cam device 212 rotates about the axis 214, the oval shape of the cam device 212 causes the rolling inhibitor A 208 to move up and down, thereby inhibiting or allowing ball 200 to roll out of the guide channel 202. The cam device 212 is powered by the same drive motor 68 as shown in FIGS. 2 and 3, which allows for a fixed timing relationship where ball 200 is positioned on T-plate 204 at a time that the T-plate 204 is not being propelled upward.

While ball 200 is being positioned on the T-plate 204, and while it is being propelled, the next queued ball 220 is inhibited from rolling down the guide channel 202 by rolling inhibitor B 222. Rolling inhibitor B 222 is controlled by a cam device 224 analogous to the cam device 212. Cam device 224 similarly includes an axis 226 about which the cam device 224 rotates, and also includes wheel guide path 228 to allow wheel 230 to follow. Cam device 224 is also powered by drive motor 68, which allows for a fixed timing relationship between the time that the ball 200 is positioned on T-plate 204 and the time that the ball 220 is allowed to progress down the guide tube 202. The difference between cam devices 212 and 224 is the orientation of the oval cam device with respect to their respective axis. The cam devices are rotated approximately 90 degrees with respect to each other so that when one of the rolling inhibitors A 208 or B 222 is at its highest position, the other is at its lowest position. This provides a synchronized release of ball 200, where ball 220 is restrained from rolling further until after ball 200 has been propelled from the ball projector 50.

Referring now to FIG. 9, an illustration of the position of the queued balls is shown at a time when each of the cam devices 212 and 224 have rotated 90 degrees. When ball 200 has been launched, another ball gets into position to be rolled into the guide tube 206 by lowering the rolling inhibitor B 222, and raising rolling inhibitor A 208. This allows all of the queued balls to move ahead in the guide channel 202. Then, as the cam devices 212 and 224 again rotate another 90 degrees, rolling inhibitor B 222 again returns to its upper position and rolling inhibitor A 208 returns to its lower position, as was previously described in connection with FIG. 8. In this manner, a plurality of balls may be queued without a risk of the queued balls interfering with the launching of the target ball.

Figure 10:
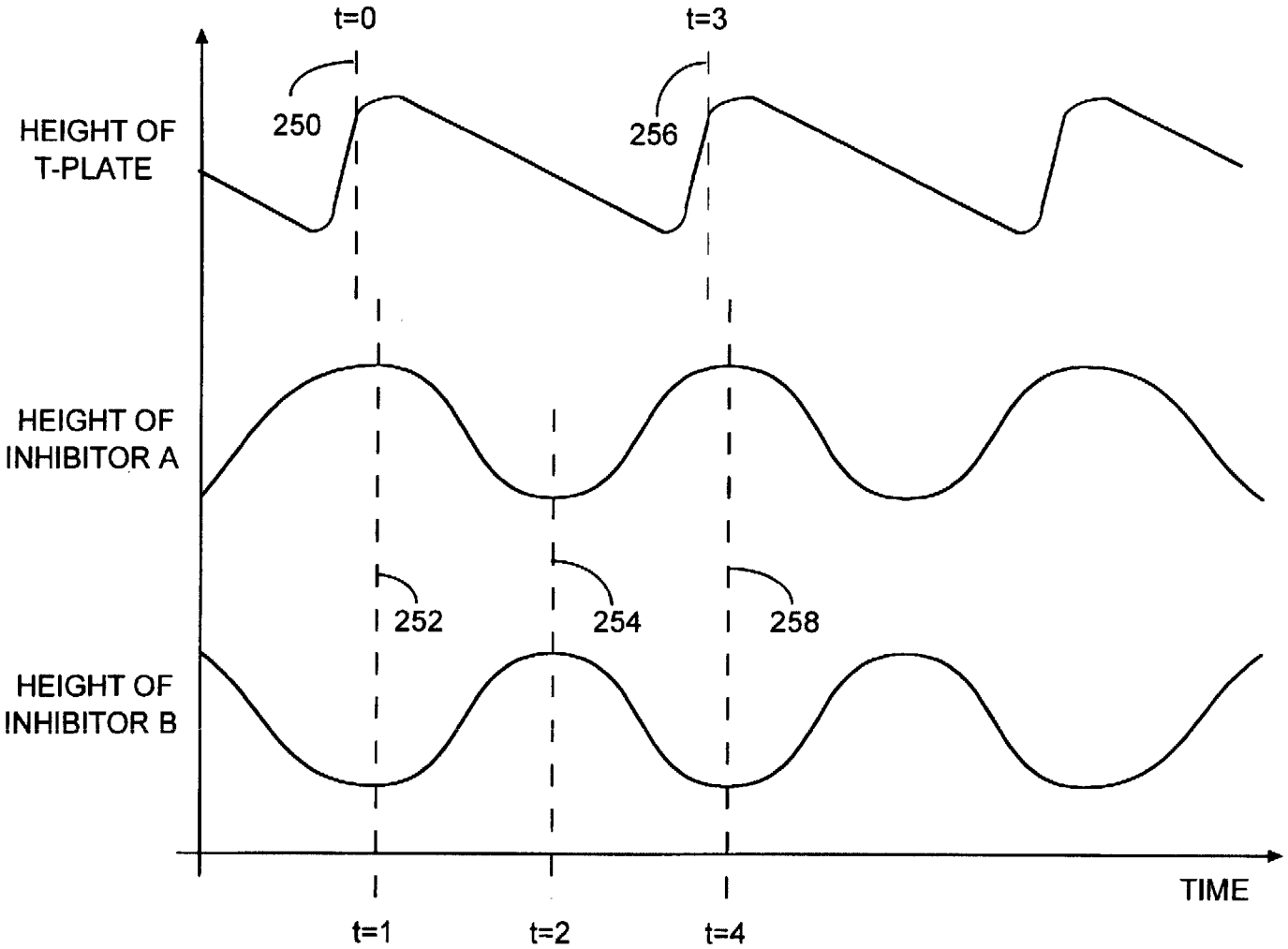
FIG. 10 is a timing diagram illustrating the timing relationship between the launching of the target ball, as compared to the height of the rolling inhibitors A and B.

FIG. 10 is a timing diagram illustrating the timing relationship between the launching of the target ball, as compared to the height of the rolling inhibitors A 208 and B 222. The T-plate 204 of FIGS. 8 and 9 moves downward due to the motion of the cam wheels, previously described in connection with FIGS. 3 and 4, which thereby compresses an axial compression spring until the release mechanism allows the axial compression spring to release its stored energy and propel the target ball. The height of the T-plate as it is launching the ball is shown at time t=0, represented by line 250, which shows the T-plate 204 very quickly rising, which in turn propels the ball. At time t=1, shown by line 252, the height of rolling inhibitor A 208 is at its highest position, inhibiting another ball 220 from interfering with the target ball 200. Also at time t=1, the height of rolling inhibitor B 222 is at its lowest point, allowing the queued balls to advance in the guide channel 202, as shown in FIG. 9. By time t=2, represented by line 254, inhibitor A 208 has lowered, and inhibitor B 222 has risen to be consistent with FIG. 8, when ball 200 is positioned on T-plate 204. Times t=3 and t=4, represented by lines 256 and 258, illustrate how the process is repeated.

The invention has been described in its presently contemplated best mode, and it is clear that it is susceptible to various modifications, modes of operation and embodiments, all within the ability and skill of those skilled in the art and without the exercise of further inventive activity. Accordingly, what is intended to be protected by Letters Patents is set forth in the appended claims.

What is claimed is:

1. An automated batting swing training apparatus, comprising:

a ball projecting unit to propel balls in a substantially upward direction for a batter to hit, the ball projecting unit comprising:

a drive motor to drive a wheel drive pinion;

a cam member rotatably engaging the wheel drive pinion and axially moving a ball propelling platform in response thereto, the cam member having a recurring rod release mechanism;

a ball guide conduit encompassing the ball propelling platform, wherein the ball propelling platform moves longitudinally within a guide cylinder; and an axial compression spring having a first end coupled to the guide cylinder, and a second end positioned against the ball propelling platform, wherein the ball propelling platform is propelled axially outward from the direction of the compression of the axial compression spring, and in the longitudinal direction of the guide cylinder, upon activation of the recurring rod release mechanism;

a ball stopping device, having a substantially non-resilient portion positioned to absorb a force of the balls resulting from being hit by a batter;

a containing unit located at a base of the ball stopping device and positioned to collect the balls; and a guide channel, demountably connected to the containing unit and the ball projecting unit at opposite ends, wherein the guide channel is sloped downward from the containing unit to the ball projecting unit to return the balls to the ball projecting unit by way of gravity.

* * * * *